US006773579B2

(12) United States Patent
Siskin et al.

(10) Patent No.: US 6,773,579 B2
(45) Date of Patent: Aug. 10, 2004

(54) PROCESS FOR REDUCING FOULING IN REFINERY PROCESSES

(75) Inventors: Michael Siskin, Randolph, NJ (US); Simon Robert Kelemen, Annandale, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 22 days.

(21) Appl. No.: 10/308,283

(22) Filed: Dec. 3, 2002

(65) Prior Publication Data

US 2003/0121823 A1 Jul. 3, 2003

Related U.S. Application Data

(63) Continuation-in-part of application No. 09/803,577, filed on Mar. 9, 2001, now Pat. No. 6,533,922.

(51) Int. Cl.[7] ..... C10G 9/12; C10G 15/00; C10G 35/00; C10B 55/00

(52) U.S. Cl. ..... 208/48 R; 208/50; 208/52 R; 208/106; 208/131

(58) Field of Search ..... 208/48 R, 50, 208/52 R, 106, 131

(56) References Cited

U.S. PATENT DOCUMENTS

| | | | | | |
|---|---|---|---|---|---|
| 3,580,959 | A | * | 5/1971 | Dorner et al. | 260/683 |
| 3,687,840 | A | * | 8/1972 | Sze et al. | 208/131 |
| 3,959,115 | A | * | 5/1976 | Hayashi et al. | 208/53 |
| 4,199,434 | A | * | 4/1980 | Sze et al. | 208/40 |
| 4,267,031 | A | * | 5/1981 | Hirabayashi et al. | 208/106 |
| 4,361,478 | A | * | 11/1982 | Gengler et al. | 208/130 |
| 4,797,197 | A | * | 1/1989 | Mallari | 208/131 |
| 4,908,121 | A | * | 3/1990 | Hackemesser et al. | 208/85 |

FOREIGN PATENT DOCUMENTS

| | | | | |
|---|---|---|---|---|
| EP | 1557809 | * | 12/1979 | C10C/3/00 |

* cited by examiner

*Primary Examiner*—Walter D. Griffin
*Assistant Examiner*—Tam M Nguyen
(74) *Attorney, Agent, or Firm*—George B. Georgellis; Jeremy J. Kliebert

(57) ABSTRACT

A process for substantially decreasing fouling in a refinery unit. The process comprises preheating a feed to said refinery unit reactor zone and there-after introducing the feed into said refinery unit reactor zone for reaction. The feed is preheated for a time and at a temperature sufficient to cause an effective amount of any polymers and/or oligomers contained in feed to decompose or unzip to substantially reduce fouling in the refinery unit.

13 Claims, No Drawings

PROCESS FOR REDUCING FOULING IN REFINERY PROCESSES

This application is a Continuation-in-Part of U.S. Ser. No. 09/803,577 filed Mar. 9, 2001 now U.S. Pat. No. 6,533,922.

FIELD OF THE INVENTION

The present invention generally relates to a method for reducing fouling in refinery units. More specifically, the invention relates to a method for reducing fouling in coking processes and fluid catalytic cracking (FCC).

BACKGROUND OF THE INVENTION

Fluidized bed coking (fluid coking) and FLEXICOKING are petroleum refining processes in which mixtures of heavy petroleum fractions, typically the non-distillable residue (resid) from fractionation, are converted to lighter, more useful products by thermal decomposition (coking) at elevated reaction temperatures, typically about 900° F. to 1100° F. (about 480° C. to 590° C.) by heat supplied by fluidized coke particles.

Fouling in the stripper and scrubber sections of a Coker vessel results in decreased capacity and Run length of the unit, culminating in costly unplanned shutdowns.

Fluid Catalytic Cracking (FCC) is another petroleum refining conversion process in which heavy oil, typically the highest boiling distillable fraction, is converted to gasoline, diesel and jet fuel, heating oil, liquefied petroleum gas (LPG), chemical feedstocks, and refinery fuel gas by catalytic decomposition at similarly elevated temperatures of about 900° F. to 1100° F. (about 480° C. to 590° C.). Run length or capacity of an FCCU may likewise be limited by deposition of coke in the stripper, reactor overhead, plenum, nozzle, transfer line, or inlet to the fractionator.

What is needed in the art is an efficient, predictable, and effective way to mitigate the fouling tendency in the stripper, scrubber, surge drum and other sections of coking units.

SUMMARY OF THE INVENTION

An aspect of the invention is directed to a process for decreasing fouling in refinery unit reactor zones. Said refinery units operate at temperatures of at least about 300° C. as measured in the reactor zone. The method comprises preheating a feed to the refinery unit reactor zone and thereafter introducing the feed into the refinery unit reactor zone for reaction. The feed contains polymers and/or oligomers. The feed is preheated for a time and at a temperature sufficient to unzip an effective amount of said polymers and/or oligomers contained in said feed during the preheating step. The preheating step substantially reduces fouling in the refinery unit. Also, the upper limit for the temperature of the preheating is determined to prevent coke formation of more than about 5 percent by weight (wt %).

The invention is particularly useful in coking and cracking refinery units.

DETAILED DESCRIPTION OF THE INVENTION

Typically, hydrocarbon feeds to refinery coking units, may contain polymers and/or oligomers. These compounds may form in petroleum feeds by thermally initiated oxidative oligomerization reactions with certain feed components and are typically present in amounts of from about 0.02 wt % to about 5 wt % (200 to 50,000 wppm) in the feed. It is believed that these polymers and/or oligomers increase fouling in refinery reactors and equipment. Without wishing to limit the invention in any way it is believed that upon entering the reactor these compounds coat and/or thermally alkylate metal surfaces and the surfaces of any formed coke particles, making them sticky. Sticky coke particles can then agglomerate and also stick to the reactor and related equipment metallic and coke covered surfaces. The feed coating a coke particle surface can undergo further thermal conversion and a mesophase can form at the coke particle contact point, binding the coke particles together. The mesophase formation of the feed between the contact points of agglomeration is believed to be one mechanism leading to cementing together coke particles that were previously held together by weaker adhesive forces.

Typical feeds to coking units may comprise many different polymers, oligomers and mixed polymers and oligomers formed with styrenes, methylstyrenes, indenes, methylindenes and conjugated dienes with minor amounts of indoles, carbazoles, phenols, naphthols, thiophenols, thionaphthols, and the like components. The oligomers/polymers, depending on their molecular weight and the refinery unit reaction temperature, can become sticky and coat or alkylate coke particles with a sticky layer. It is believed that this sticky layer can lead to agglomeration of the coke particles and further coke formation at the contact points of agglomeration before they undergo sufficient thermal cracking conversion to reduce their stickiness via unzipping of the polymer chain.

In typical refinery unit operations, preheat treatments are typically used to raise the temperature of a feed to a desired temperature for energy balance purposes. Once the feed reaches the desired temperature, it is injected through feed nozzles into the reactor, or introduced by other means. It has been discovered that such a preheat scheme is inadequate to unzip any substantial amount of these sticky polymers and/or oligomers found in a feed. Upon entering the reactor the polymers and/or oligomers can lead to increased fouling. For example, thermal alkylation or coating of coke particles by long sticky oligomers and/or polymers may cause coke particle agglomeration. The heavier agglomerated sticky coke particles carry under to the stripper sheds and stick to the sheds causing fouling and buildup of foulant material. Applicants have unexpectedly discovered that preheating can be used to substantially reduce fouling in a refinery unit. Specifically, preheating a refinery feed containing a substantial amount of polymer and/or oligomers, for an amount of time and at a preheat temperature sufficient to unzip an effective amount of said polymers and/or oligomers substantially reduces fouling in the reactor and related reaction zone equipment such as stripper sheds. Without wishing to limit the invention in any way it is postulated that this additional preheating may prevent thermal alkylation and/or coating of coke particles by the most sticky polymeric materials. Alkylation and coating by smaller polymeric units and/or oligomers is then more easily overcome by thermal decomposition reactions at the higher temperature of the coke particles inside the reactor. For example, typically a reactor operating temperature may be about 530° C. while the feed may be preheated to about 345° C. in the preheat section of the reactor.

Thus, an embodiment of the invention includes preheating the feed to the refinery unit to a bulk temperature compatible with the economics of the unit and additionally continuing to preheat and thereafter introducing the feed into the reaction zone such that the combination of additional preheating and the heating which occurs due to the heating of the feed in the reaction zone causes at least 30%, preferably 50%, more preferably at least about 60%, and most preferably at least about 85% by weight of the polymers and oligomers contained in the feed to unzip. The preheating prior to introduction into the reaction zone is conducted such that no more than about 5 wt % coke is formed in the feed prior to introducing the feed into the reaction zone. The amount of polymers and/or oligomers that unzip is determined by a skilled artisan by running a Thermal Gravimetric Analysis (TGA) on the feed and determining the activation parameters; the preexponential factor and activation energy. The amount of unzipping many include both the amount of unzipping that occurs during preheating in addition to the amount of additional unzipping that would occur during the residence time of the feed in the reactor. For example, to determine if at least about 85% unzipping has occurred, in both the preheating and heating steps, the minimum residence time instead of the average residence time of the feed in the reaction zone would be utilized in the calculation for determining the amount of unzipping. This is because the amount of unzipping in the reactor should only be calculated for the minimum time that the coated coke particle could experience in the reactor section to be certain that it will be dry and not sticky when it enters other areas of the process, e.g., the stripper section.

Preferably, the feed may be preheated at a temperature of at least about 300° C. for a time sufficient to cause a substantial amount of polymers and/or oligomers present in the feed which can coat and cause alkylation of coke to unzip. The preheating may be conducted at a temperature of at least about 300° C., preferably from about 300° C. to about 400° C., and more preferably from about 350° C. to about 370° C. The feed may preferably be preheated for an average residence time of at least about 5 minutes, more preferably for at least about 10 minutes, and most preferably for at least about 15 minutes. Although longer times may be utilized, it is preferable to preheat the feeds for a maximum time of about 1 hour, more preferably for a maximum time of about 30 minutes since longer times impact adversely the economics of the process. Care should be exercised during the preheating step to prevent formation of more than about 5 wt % coke particles in the feed that could precipitate and coat the preheat section walls and result in decreased yield of product and potentially in fouling of the preheat section.

Preheating may be accomplished with any suitable heating means, such as pipes, holding tanks, etc., that provide the required residence time and temperature. Preheat temperatures should preferably be below coke formation temperatures, e.g., about 400° C., preferably about 370° C. to prevent coke formation in the preheat section, but high enough to degrade or unzip the sticky polymers and/or oligomers. A plot for the cumulative unzipping of the pure polystyrene of MW 230,000 shows that about 10 wt % of the polymer is unzipped every 10 minutes at 348° C., S. L. Madorski, "The Thermal Degradation of Organic Polymers", Interscience Publishers, New York, N.Y. 1963, which is incorporated herein by reference for all purposes to the extent that it is not inconsistent with the present invention disclosure and claims.

Preheating the feed to substantially reduce the amount of polymers and oligomers in the feed as taught herein, may also decrease the viscosity of the feed. This often may be beneficial to the subsequent reaction step, as for example in coking processes wherein generally lower viscosity feeds achieve higher conversions at faster rates because they form thinner and more even coatings on coke particles. Thinner coatings may also favor higher product yields, better product quality and lower levels of bogging of coke particles in the fluidized bed. More even coatings also may prevent buildup of unconverted thick spots that form dry coke at slower rates and make the coke particles more sticky and more susceptible to agglomeration.

The residence time and the temperature of the preheating step required for any given feed may vary. Generally, a preheating residence time and temperature sufficient for a particular feed are those necessary for the polymers and/or oligomers present in the feed, or a portion thereof, to become substantially less sticky or unzipped. One skilled in the art can readily determine the required preheating times and temperatures within the constraints taught herein. For example, it is well known that a clay-gel separation can be run on a sample of the feed to isolate the amount of polymeric material contained therein. A TGA can then be run to determine the weight loss profile. Thus, one skilled in the art would be able to select the appropriate times and temperatures, from the weight loss profile, within the given ranges at which to run the process. Table 1 illustrates the results based on analysis of TGA data for two different samples of polymers/oligomers isolated by clay-gel separation.

TABLE 1

| Sample | Time (Minutes) | Extent of Reaction at 300° C. | Extent of Reaction at 330° C. | Extent of Reaction at 360° C. |
|---|---|---|---|---|
| Oligomers from T90 fraction of Heavy Catalytic Naphtha (HCN) | 30 | 15% | 50% | 97% |
| Oligomers from Heavy Coker Gas Oil (HKGO) | 30 | 34% | 93% | 100% |
| Oligomers from T90 fraction of Heavy Catalytic Naphtha (HCN) | 60 | 45% | 97% | 100% |
| Oligomers from Heavy Coker Gas Oil (HKGO) | 60 | 87% | 100% | 100% |
| Oligomers from T90 fraction of Heavy Catalytic Naphtha (HCN) | 180 | 100% | 100% | 100% |
| Oligomers from Heavy Coker Gas Oil (HKGO) | 180 | 100% | 100% | 100% |

The Arrhenius Parameters deduced from TGA data for HCN oligomers were $A=1.6\times10^{11}$ and Ea=40.0 kcal/mole. The Arrhenius Parameters deduced from TGA data for HKGO oligomers were $A=4.0\times10^{12}$ and Ea=42.3 kcal/mole. These A and Ea parameters are lower than those typically associated with petroleum residua thermal cracking decomposition ($A=1\times10^{13}$, Ea=51 kcal/mole) and consistent with polymer unzipping (decomposition/cracking) kinetics. It is clear from the data that preheating for 30 minutes at 360° C. will eliminate these species from the feed. Therefore, in these cases, in combination with a higher temperature coking process, preheating at 30 minutes or less would be sufficient.

Once the feed has undergone the preheating step described herein it is introduced into the reaction zone of the refinery unit. The reaction zone which is at about 530° C. causes further unzipping of oligomers and polymers at an unzipping rate about 30 to 50 times faster than in the preheat section before the reactor. Thus, since additional unzipping occurs in the reaction itself, shorter preheating times are possible. However, preheating is required to achieve most favorable process heat integration. Additionally, the average residence time of a coke particle in the reaction section is about 10 minutes, but since the residence time of some of the material in the reactor can be only about 10 to 25 seconds, the concern for making sticky coke is alleviated by the additional preheating as taught by the present invention.

Preferably, the preheated feed should not be allowed to cool and sit for extended times because reoligomerization of the decomposition products that are soluble in the feed will likely take place.

The present invention achieves a balance between preheating the feed for a time and temperature sufficient to cause substantial unzipping of polymeric and oligomeric materials to prevent fouling in the reacting zone and not overheating the feed in a manner that would form significant amounts of coke. Preferably, less than 5 wt % coke is formed in the preheating step.

In most cases, the preheating step described herein can be readily accomplished in existing preheat zones of refinery units.

The following examples are meant to be illustrative and not limiting in any way.

EXAMPLE 1

The following test was candied out on a Vacuum Topped Bitumen (VTB) to which a polystyrene oligomer (PS) of about 25 units was added for illustrative purposes.

TABLE 2

| | Viscosity at 80° C. (CPS) |
|---|---|
| Untreated (NO HEAT) | |
| VTB | 96,800 |
| VTB + 2% PS MW = 2500 | 96,800 |
| HEATED AT 360° C. for 3 hours | |
| VTB | 9,400 |
| VTB + 2% PS MW = 2500 | 4,500 |
| HEATED AT 360° C. for 0.5 hours | |
| VTB | 23,000 |
| VTB + 2% PS MW = 2500 | 15,600 |

The results show that polystyrene has no effect on the viscosity of untreated VTB. Heating for 3 hours at 360° C. decreased the viscosity of the VTB tenfold. However, in the presence of 2 wt % PS of MW=2500, the viscosity is cut in half again by heating. This indicates that if sticky oligomers are present in the feed, then a longer heat soak would be beneficial in shortening the sticky chains causing reduced stickiness.

Also, the decomposition products of the polymer unzipping can provide additional solvent to further reduce the viscosity of the VTB. Since 3 hours is not a feasible time from a commercial perspective for heating the feed, the experiment was repeated for 0.5 hours. Here, a fourfold decrease in viscosity vs. the unheat-treated case was observed, and again a further decrease to six-fold was observed in the presence of added PS.

The viscosities of the VTB feeds that contain PS in Example 1 and which were treated for 0.5 and 3 hours at 360° C., were remeasured after sitting in a sealed bottle for six months. The viscosities at 80° C. had increased to 120,000 and 31,500 CPS, respectively, due to reoligomerization of the previously depolymerized molecules.

EXAMPLE 2

The following example was carried out on a polystyrene oligomer (PS) of about 25 units with a vacuum resid (VR).

TABLE 3

| | Viscosity at 80° C. (CPS) |
|---|---|
| Untreated (NO HEAT) | |
| VR | 5,740 |
| VR + 2% PS MW = 2500 | 4,100 |
| HEATED AT 360° C. for 3 hours | |
| VR | 1,640 |
| VR + 2% PS MW = 2500 | 1,640 |
| HEATED AT 360° C. for 0.5 hours | |
| VR | 2,460 |
| VR + 2% PS MW = 2500 | 2,005 |

The results in Table 3 illustrate that polystyrene has only a small effect on the viscosity of unheated VR. Heating for three hours at 360° C. decreased the viscosity of the vacuum resid three and one-half fold. However, in the presence of 2 wt % PS of MW 2500 the viscosity was unchanged by heating indicating that in this case the 3-hour heating time unzipped all of the polymeric material present in this feed. This indicates that if sticky oligomers are present in the feed, then a longer heat soak will be beneficial in shortening the sticky chains. Since 3 hours is not a feasible time from a commercial perspective for heating the feed, the experiment was repeated for 0.5 hours. Here, a 2.3-fold decrease in viscosity vs. the unheat-treated case was observed and a further decrease to 2.8-fold was observed in the presence of added PS.

EXAMPLE 3

The following illustrates the results of calculations based upon the activation parameters determined by TGA analysis. Extent of conversion is the weight percent of polymers and/or oligomers unzipped. Tables 4 and 5 show calculated decompositions at different preheat times and temperatures for HKGO and HCN feeds, respectively. Tables 6 and 7 show calculated extent of conversions for the HKGO feed at different reactor temperatures and residence times. Tables 8 and 9 show calculated extent of conversions for the HCN feed at different reactor temperatures and residence times.

TABLE 4

HKGO - Derived Oligomers Extent of Decomposition In The Preheat

| Reactor | Reactor Temperature | | | |
|---|---|---|---|---|
| Time (seconds) | 280° C. | 300° C. | 320° C. | 340° C. |
| 120 | 0.011 | 0.044 | 0.144 | 0.392 |
| 900 | 0.085 | 0.285 | 0.689 | 0.976 |
| 1800 | 0.162 | 0.489 | 0.903 | 0.999 |

TABLE 5

HCN - Derived Oligomers Extent of Decomposition In The Preheat

| Reactor | Reactor Temperature | | | |
|---|---|---|---|---|
| Time (seconds) | 280° C. | 300° C. | 320° C. | 340° C. |
| 120 | 0.004 | 0.013 | 0.042 | 0.122 |
| 900 | 0.028 | 0.095 | 0.277 | 0.623 |
| 1800 | 0.055 | 0.181 | 0.477 | 0.858 |

TABLE 6

HKGO (polymers/oligomers) - 300° C. - 120 seconds (preheating time) - Extent of Conversion in the Preheat = 0.044

| Reactor | Reactor Temperature | | | |
|---|---|---|---|---|
| Time (seconds) | 410° C. | 450° C. | 490° C. | 530° C. |
| 0.0 | 0.044 | 0.044 | 0.044 | 0.044 |
| 0.1 | 0.057 | 0.117 | 0.337 | 0.777 |
| 0.3 | 0.084 | 0.246 | 0.681 | 0.988 |
| 1.0 | 0.171 | 0.566 | 0.975 | 1.000 |
| 3.0 | 0.376 | 0.911 | 1.000 | 1.000 |
| 10.0 | 0.770 | 1.000 | 1.000 | 1.000 |
| 30.0 | 0.987 | 1.000 | 1.000 | 1.000 |

TABLE 7

HKGO - 300° C. - 1,800 seconds - Extent of Conversion = 0.489

| Reactor | Reactor Temperature | | | |
|---|---|---|---|---|
| Time (seconds) | 410° C. | 450° C. | 490° C. | 530° C. |
| 0.0 | 0.489 | 0.489 | 0.489 | 0.489 |
| 0.1 | 0.497 | 0.528 | 0.646 | 0.881 |
| 0.3 | 0.511 | 0.597 | 0.830 | 0.994 |
| 1.0 | 0.557 | 0.768 | 0.987 | 1.000 |
| 3.0 | 0.667 | 0.952 | 1.000 | 1.000 |
| 10.0 | 0.877 | 1.000 | 1.000 | 1.000 |
| 30.0 | 0.993 | 1.000 | 1.000 | 1.000 |

TABLE 8

HCN (polymers/oligomers) - 300° C. - 120 sec - Extent of Conversion = 0.013

| Reactor | Reactor Temperature | | | |
|---|---|---|---|---|
| Time (seconds) | 410° C. | 450° C. | 490° C. | 530° C. |
| 0.0 | 0.013 | 0.013 | 0.013 | 0.013 |
| 0.1 | 0.016 | 0.028 | 0.076 | 0.227 |
| 0.3 | 0.022 | 0.058 | 0.191 | 0.525 |
| 1.0 | 0.043 | 0.155 | 0.490 | 0.914 |
| 3.0 | 0.100 | 0.380 | 0.864 | 0.999 |
| 10.0 | 0.274 | 0.791 | 0.999 | 1.000 |
| 30.0 | 0.607 | 0.991 | 1.000 | 1.000 |

TABLE 9

HCN - 300° C. - 1,800 seconds - Extent of Conversion = 0.181

| Reactor | Reactor Temperature | | | |
|---|---|---|---|---|
| Time (seconds) | 410° C. | 450° C. | 490° C. | 530° C. |
| 0.0 | 0.181 | 0.181 | 0.181 | 0.181 |
| 0.1 | 0.183 | 0.194 | 0.233 | 0.359 |
| 0.3 | 0.188 | 0.218 | 0.328 | 0.606 |
| 1.0 | 0.206 | 0.299 | 0.577 | 0.929 |
| 3.0 | 0.253 | 0.486 | 0.887 | 0.999 |
| 10.0 | 0.397 | 0.826 | 0.999 | 1.000 |
| 30.0 | 0.674 | 0.992 | 1.000 | 1.000 |

What is claimed is:

1. A method for substantially decreasing fouling in a refinery unit having at least one refinery unit reactor for reacting a feed containing polymers and/or oligomers at a temperature of at least about 300° C., the method comprising: preheating said feed to said refinery unit reactor and thereafter introducing said feed into said refinery unit reactor for reaction, wherein said feed is preheated for a time and at a temperature sufficient to cause an effective amount of said polymers and/or oligomers contained in said feed to unzip to substantially reduce fouling in said refinery unit, and wherein no more that about 5 wt % coke is formed in said feed during said preheating step.

2. The method of claim 1, wherein said feed is preheated at a temperature of from about 300° C. to about 360° C. and for a residence time of at least about 5 minutes.

3. The method of claim 1, wherein feed is preheated at a temperature of from about 300° C. to about 360° C. and for a residence time of at least about 10 minutes.

4. The method of claim 1, wherein said feed is preheated at a temperature of from about 300° C. to about 360° C. and for a time of from about 5 minutes to about 50 minutes.

5. The method of claim 1, wherein said feed is preheated at a temperature of from about 340° C. to about 360° C. and for a time of from about 10 minutes to about 40 minutes.

6. The method of claim 1, wherein said effective amount of said polymers and oligomers is reduced by at least about 10 percent by weight.

7. The method of claim 1, wherein said effective amount of said polymers and oligomers is reduced by at least about 30 percent by weight.

8. The method of claim 1, wherein said effective amount of said polymers and oligomers is reduced by at least about 50 percent by weight.

9. The method of claim 1, wherein said refinery unit has at least one refinery unit reactor operating at a temperature of at least about 450° C.

10. The method of claim 1, wherein said refinery unit has at least one refinery unit reactor operating at a temperature of at least about 500° C.

11. The method of claim 1, wherein said refinery unit is selected from the group comprising fluid catalytic cracking units and coking units.

12. The method of claim 1, wherein said refinery unit has at least one refinery unit reactor operating at a temperature of from about 480° C. to about 590° C.

13. The method of claim 1, wherein said feed is a vacuum topped bitumen or a vacuum residual.

* * * * *